US005862753A

United States Patent [19]

Dolan et al.

[11] Patent Number: 5,862,753

[45] Date of Patent: Jan. 26, 1999

[54] INK JET PRINTING APPARATUS WITH HANDHELD APPLICATOR

[75] Inventors: Donald T. Dolan, Ridgefield; Pushpavadan S. Nagarsheth, Danbury, both of Conn.

[73] Assignee: Pitney Bowes, Inc., Stamford, Conn.

[21] Appl. No.: 751,633

[22] Filed: Nov. 18, 1996

[51] Int. Cl.[6] ..... B41F 7/02

[52] U.S. Cl. ..... 101/217; 101/91; 400/82; 347/103; 347/109

[58] Field of Search ..... 400/88, 82; 101/91, 101/217; 347/103, 109

[56] References Cited

U.S. PATENT DOCUMENTS

| | | | |
|---|---|---|---|
| 2,660,111 | 11/1953 | Herrick et al. . | |
| 3,376,812 | 4/1968 | Sterling . | |
| 3,522,769 | 8/1970 | Priesmeyer | 101/3 |
| 3,536,007 | 10/1970 | Harvey | 101/327 |
| 3,688,695 | 9/1972 | James | 101/211 |
| 3,701,317 | 10/1972 | Miyameric | 101/170 |
| 3,724,369 | 4/1973 | Gery | 101/327 |
| 3,732,809 | 5/1973 | Sawada | 101/35 |
| 3,752,068 | 8/1973 | Trampoech | 101/93 |
| 3,869,986 | 3/1975 | Hubbard | 101/91 |
| 3,964,383 | 6/1976 | Delligatti | 101/44 |
| 4,052,938 | 10/1977 | Kirby | 101/291 |
| 4,116,126 | 9/1978 | Miner | 101/77 |
| 4,402,263 | 9/1983 | Honkawa | 101/350 |
| 4,403,547 | 9/1983 | Forberger | 101/170 |
| 4,508,034 | 4/1985 | Schuneman | 101/365 |
| 4,611,538 | 9/1986 | Simeth | 101/365 |
| 4,615,266 | 10/1986 | DeRoche et al. | 101/163 |
| 5,593,236 | 1/1997 | Bobry | 400/88 |
| 5,619,240 | 4/1997 | Pong et al. | 347/103 |
| 5,634,730 | 6/1997 | Bobry | 400/88 |

*Primary Examiner*—Ren Yan
*Attorney, Agent, or Firm*—Ronald Reichman; Robert H. Whisker; Melvin J. Scolnick

[57] ABSTRACT

An apparatus and method for printing postal indicia and similar images. The apparatus includes two print stations and an ink jet printhead transportable between the stations. The printhead forms images on a transfer roller located at each of the stations and the image is then transferred from the roller to a substrate. At the second station the transfer roller is incorporated in a detachable roller and is used to print remotely located substrates.

13 Claims, 3 Drawing Sheets

INK JET PRINTING APPARATUS WITH HANDHELD APPLICATOR

BACKGROUND OF THE INVENTION

The subject invention relates to an apparatus and method for printing images. More particularly, it relates to an apparatus and method for printing images such as postal indicia printed by postage meters to evidence that appropriate postage has been paid on a mail piece as evidence that postage has been paid, i.e. that the prepaid amount stored in the meter has been properly decremented, a postal indicia on a mail piece.

A typical indicia includes fixed elements such as city name, state, meter identification, arbitrary and complex elements to inhibit counterfeiting of the indicia, and variable elements such as date, and, of course, a postage amount represented by the indicia. Typically indicia have been printed by complex mechanical rotary or flat bed printing elements which include a fixed printing element for printing fixed information and adjustable elements for printing variable information.

One problem with such postage meters has been providing indicia for packages or other bulky articles on which a postage meter cannot print directly. Heretofore indicia for packages have been printed on separate labels or tapes which were then applied to the package in the same manner as a postage stamp. While generally satisfactory the cost of label stock represents a significant cost for mailers, particularly in developing countries where postal rates are low.

Recently postage meters using digital printing have been proposed to allow incorporation of encrypted information in indicia to deter counterfeiting as well as to simplify printing of variable information in indicia. One particularly desirable form of digital printing which has been proposed for use in a postage meter is ink jet printing, and particularly piezoelectric ink jet printing. One such postage meter is described in commonly assigned, co-pending U.S. patent application Ser. No. 554,179, filed Nov. 6, 1995, for MAIL HANDLING APPARATUS AND PROCESS FOR PRINTING AN INDICIA COLUMN-BY-COLUMN IN REAL TIME, by Arsenault et al. (E-394) In this meter a printhead having a number of ink jets is oriented transversely to the printing direction and is moved over the mailpiece to print the indicia. Because the printhead has a density of 80 jets per inch while a vertical resolution of 240 dots per inch is desired for the indicia, the printer described in the above reference application prints the indicia in 3 interleaved passes.

Thus, it is a object of the subject invention provide an improved apparatus and method for printing images such as postal indicia on packages or other bulky articles on which a postage meter cannot print directly.

BRIEF SUMMARY OF THE INVENTION

The above object is achieved and the disadvantages of the prior art are overcome in accordance with the subject invention by means of an apparatus and method wherein a first station for the temporary attachment of a transportable transfer roller is provided in an apparatus for printing an image on a substrate. An image forming mechanism responsive to signals representative of images to be printed is positioned proximate to the first station to form corresponding reversed images on a transfer roller attached to the first station. When the transportable transfer roller is attached to the first station it is then rotated synchronously with the operation of the image forming mechanism as the mechanism forms a reverse of the image on the transportable transfer roller. The transportable transfer roller is then detached from the first station, transported to the substrate and applied to the substrate to print the image.

In accordance with one aspect of the subject invention the image is a postal indicia.

In accordance with another aspect of the subject invention the substrate is a package.

In accordance with another aspect of the subject invention the apparatus includes a fixed transfer roller at a second station and a mechanism for transporting the image forming mechanism between the first station and second station. The image forming mechanism is positioned proximate to the first station when a remotely located substrate such as a package is to be printed, and positioned proximate to the second station when an envelope is to be printed.

In accordance with still another aspect of the subject invention the transportable transfer roller includes a one-way single revolution clutch to assure that the image is applied in the right direction and that only a single image is applied.

In accordance with still yet another aspect of the subject invention, the image is formed as successive interlaced portions during successive revolutions of the transportable transfer roller.

Thus it can be seen that the subject invention advantageously achieves the above object and overcomes the disadvantages of the prior art. Other objects and advantages of the subject will be apparent to those skilled in the art from consideration of the detailed description set forth below and the attached drawings.

DETAILED DESCRIPTION OF PREFERRED EMBODIMENTS OF THE INVENTION

Figure 1:
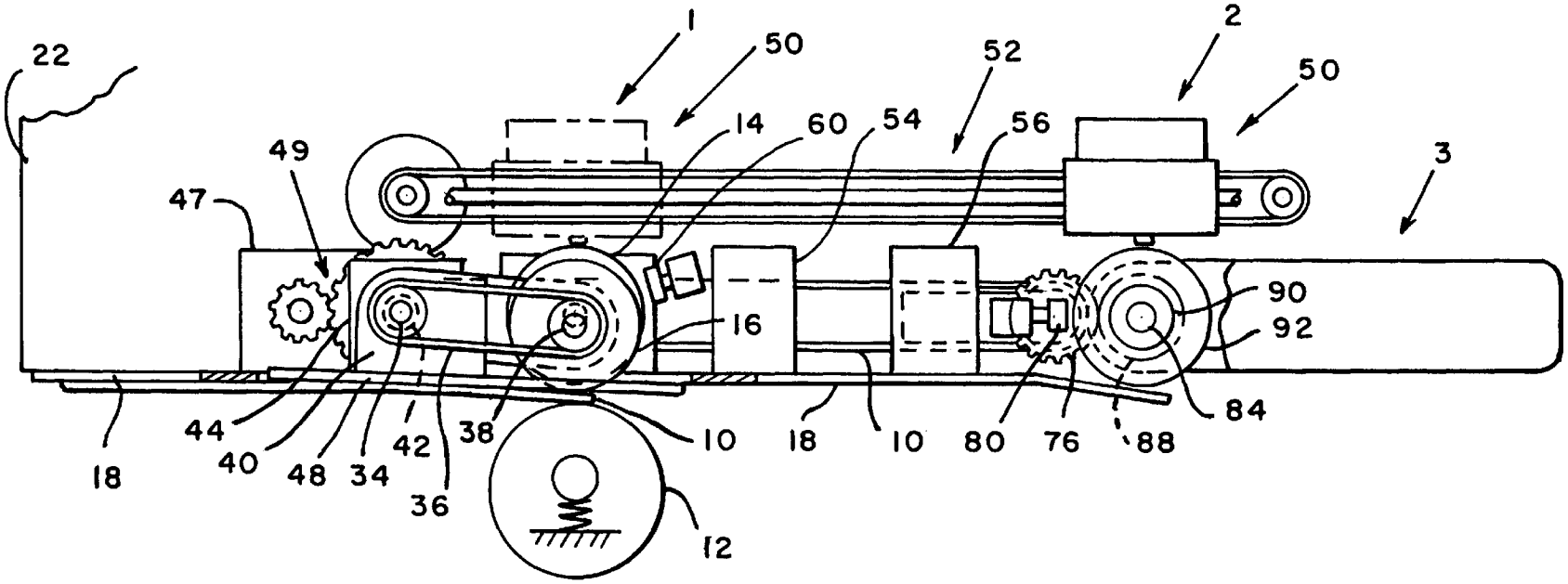
FIG. 1 shows a schematic side view of a printing apparatus in accordance with the subject invention.
Figure 2:
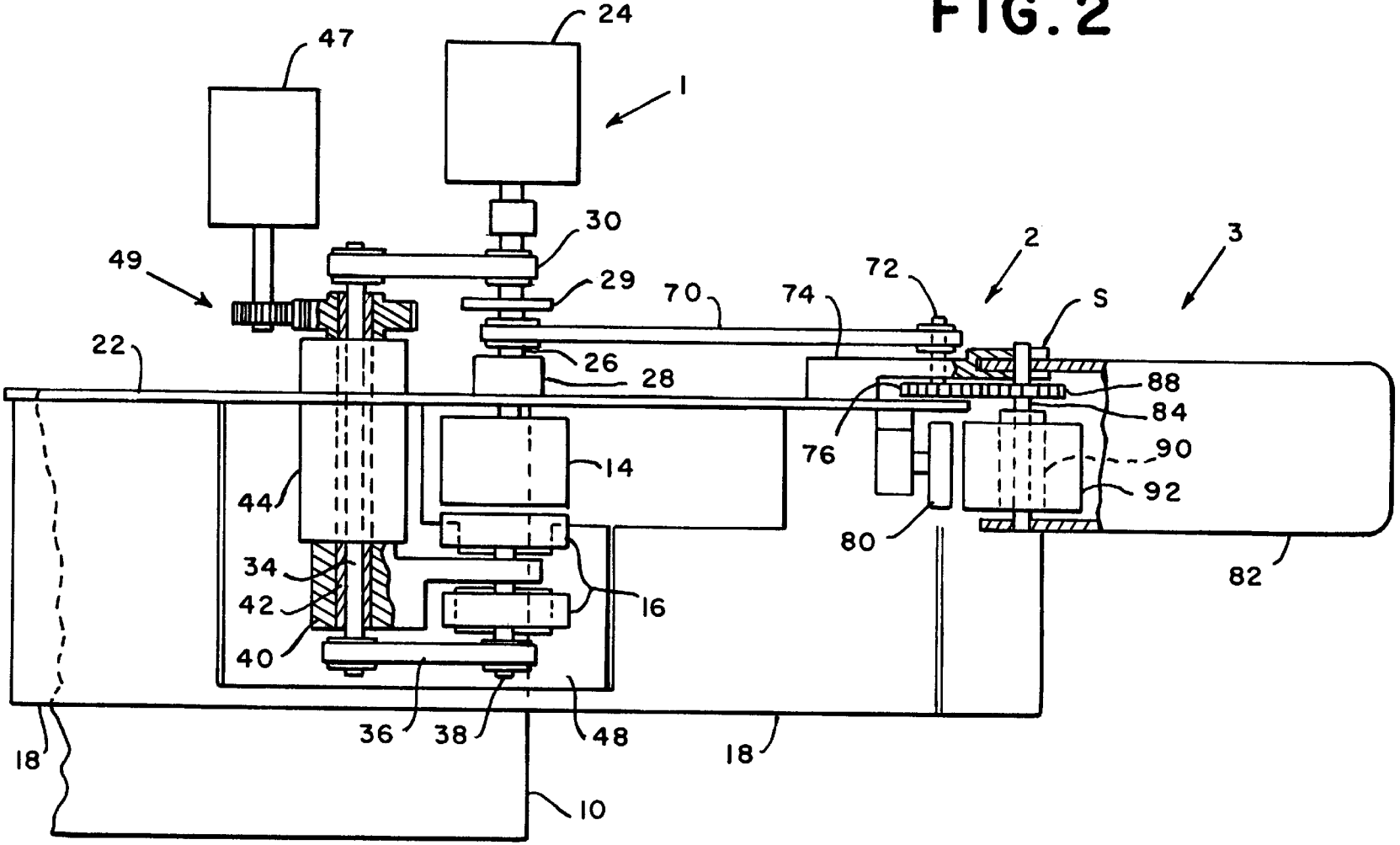
FIG. 2 shows a schematic top view of the apparatus of FIG. 1 with the image forming mechanism removed.

FIGS. 1 and 2 show a schematic representation of a printing apparatus in accordance with the subject invention. Various details of the construction not explicitly shown form no part of the subject invention per se and numerous implementations of these details would be apparent to those skilled in the art.

The apparatus shown in FIGS. 1 and 2 includes station 1 for printing envelopes and station 2 for forming reverse images of indicia to be printed on packages on a transportable transfer roller which is then applied to a package located remotely from the apparatus, as will be described further below.

Envelope 10 is fed to station 1 by a conventional demand feeder (not shown) which is controlled in a conventional manner to provide envelope 10 to station 1 in synchronism the operation of the printing apparatus.

Envelope 10 is feed into the nip formed by spring loaded impression roller 12, and transfer roller 14 and driven pivot rollers 16.

Envelope 10 is maintained in a predetermined registration with respect to transfer roller 14 by upper registration surface 18 and vertical registration surface 22.

Transfer roller 14 is driven by print motor 24 through shaft 26 which is supported by bearing block 28. A conventional encoder 29 provides angular position information in a conventional manner to synchronize control of the printing operation, as will be described further below. Pivot rollers 16 are also coupled to motor 24 by shaft 26, belt 30, inner coaxial shaft 34, belt 36, and shaft 38. Rollers 16 are thus arranged to rotate synchronously with, but separate from, transfer roller 14. Shaft 38 and roller 16 are supported by pivot arm 40 which is fixed to outer coaxial shaft 42, supported by pivot bearing block 44.

Shoe 48 is fixed to pivot arm 40 and is normally co-planar with registration surface 18.

Pivot motor 47 drives outer shaft 42 through reduction gear assembly 49 to rotate pivot arm 40, rollers 16 and shoe 48 downwards out of the plane of registration surface 18 to deflect envelope 10 away from transfer roller 14 as envelope 10 moves through the printing apparatus.

As is best shown in FIG. 1 a conventional ink jet printhead 50 (shown in phantom)is supported in a predetermined registration with respect to transfer roller 14 so that the nozzles of printhead 50 are arranged in a line parallel to the axis of transfer roller 14, preferable at a location 180 degrees from the nip of transfer roller 14 and impression roller 12. Transport mechanism 52 supports printhead 50 and under system control, transports printhead 50 to maintenance station 54 and capping station 56 between printing operations (maintenance and capping of ink jet printheads are conventional operations, well known in the art, and need not be discussed further here for an understanding of the subject invention).

Transport mechanism 52 also transport printhead 50 in the vertical direction (i.e. the direction parallel to the axis of transfer roller 14 and transverse to the print direction) to interleave successive portions of a completed image in successive passes (i.e. revolutions of transfer roller 14).

Transport mechanism 52 also transports printhead 50 to station 2 when an indicia is provided for a remotely located package or other bulky article which cannot be processed in station 1, as will be described further below.

In a preferred embodiment of the subject invention articulated cleaning roller or pad 60 is provided at station 1. Roller or pad 60 is operated under system control to bear against transfer roller 14 and remove any excess ink remaining after an image has been printed on envelope 10.

At station 2 belt 70 couples shaft 72 to shaft 26. Shaft 72 is supported by bracket 74 fixed to registration surface 22. Gear 76 is fixed to shaft 72 and rotates synchronously with shaft 26.

Transportable transfer roller 3 includes housing 82 which supports shaft 84 so that shaft 84 is free to rotate. Gear 88 is fixed to shaft 84 and engages gear 76 when transportable transfer roller 3 is temporarily attached to station 2. Gears 76 and 88 are in a 1:1 ratio so that shaft 84 rotates synchronously and at the same rate as shaft 26. The position of shaft 84 can be determined from encoder 29.

One-way, single revolution clutch 90 couples shaft 84 to transfer roller 92.

As can be best seen in FIG. 1, when printhead 50 is at station 2 transfer roller 92 will be positioned in the same spatial relationship as transfer roller 14 at station 1, and will rotate at the same rate. In the preferred embodiment shown the extended end of shaft 84 engages slot S in bracket 72 to assure proper alignment of transportable transfer roller 3. Thus, an image of a postal indicia may be formed on transfer roller 2 in a manner substantially the same as an image is formed on transfer roller 14.

Those skilled in the art will recognize that roller 92 rotates in the opposition direction from roller 14 and that accordingly printhead 50 must form the image in reverse sequence, which requires no more than a minor programming change. Of course other embodiments where roller 19 rotates in the same direction as roller 14, (such as the introduction of an idler gear) would be well within the ability of person of ordinary skill in the art.

Also, since the indicia will be applied manually with unit 3 detached from station 2, roller 92 must be properly oriented before the indicia is applied. Preferably, this achieved either by rotating roller 92 approximately 180 degrees after the indicia is formed, or by further changing the sequence in which the indicia is formed to begin in the middle of the indicia, so that the beginning and end of the indicia are approximately opposite printhead 50 when the indicia is completed.

In one embodiment of the subject invention cleaning pad 80 is operated under system control to remove any excess ink which may remain on roller 92. Preferably cleaning pad or roller 80 is applied to transfer roller 92 when transportable unit 3 is attached to station 2 and roller 92 is then driven under system control to remove any excess ink remaining after an indicia has been applied to a package. This cleaning operation may be initiated either by a sensor which senses the presence of transportable unit 3 (not shown) or by operator input.

It is also within the contemplation of the subject invention that clutch 90 may be provided with a locking mechanism which is only unlocked upon attachment of transportable unit 3 to station 2 to further assure that only a single indicia can be applied from transfer roller 92 to.

Once an indicia has been formed on transfer roller 92 transportable unit 3 is detached from station 2 and transfer roller 92 is applied to the package or other bulky item to apply the postal indicia.

Figure 3:
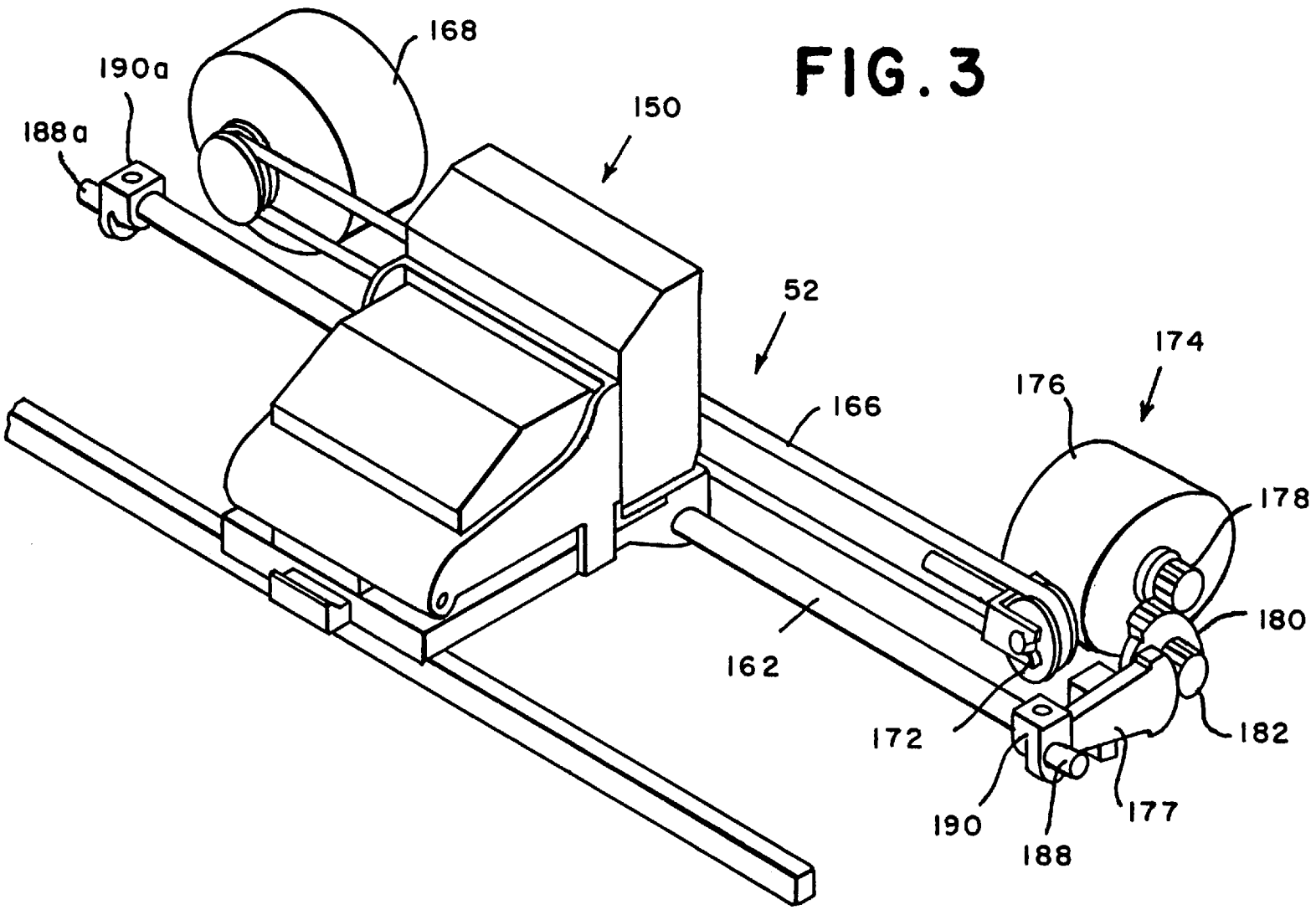
FIG. 3 shows a perspective view of a transport mechanism used in one embodiment of the subject invention.

FIG. 3 shows a more detailed representation of transport mechanism 52. Printhead 50 is mounted on guide bar 162 and is free to rotate around the axis of guide bar 162. The front of printhead 50 rests upon, and is free to slide along, rail 64. Printhead 50 is attached to endless belt 166 which is supported by motor 168 and pulley 172 so that motor 168 can transport printhead 50 between its normal position above transfer roller 14, maintenance station 54, capping station 56 and station 2.

Shifting mechanism 174 moves printhead 50 in the vertical direction. Mechanism 174 includes stepper motor 176 which drives lever arms 177 through gear train 178, 180, 182 to rotate around shaft 188. L-shaped element 190 is fixed to lever arm 177 and rotates around shaft 188 when lever arm 177 is driven. One end of guide 162 is supported by L-shaped element 190 esscentrically with respect to shaft 188. The opposite, undriven end of guide 62 is supported by similar shaft 188A and L-shaped element 190A. Thus, as stepper motor 176 drives lever arm 177 printhead 50 is moved through a small part of an arc in the vertical direction. However, since printhead 50 is free to rotate around guide 62 and slide across support 64 any displacement out of the plane is negligible. Preferably mechanism 174 is designed so that one step of stepper motor 176 moves printhead 50 a small fraction of a pixel size in the vertical direction.

Thus, printhead 15 may be operated in either of two modes to print portions of a complete reverse image onto transfer roller 14 or transfer roller 92 during successive passes. In the first mode the circumference of rollers 14 or 92 may be chosen so that an adequate dead space is provided between the beginning and the end of the reverse image so that printhead 50 may be displaced by a full pixel dimension between completion of the printing of one portion and beginning of printing of the next portion. In the second mode of operation printhead 50 is successively displaced by sub-pixel increments as each portion of the reverse image is printed so that printhead 50 is displaced by a full pixel dimension after the entire portion is printed. This, of course, will slightly tilt the printed image but it is believed that for images such as postal indicia this effect will be negligible and that compensation for this effect can be made in designing the indicia.

Of course successive portions of an image may be printed on transfer rollers 14 or 92 with increased resolution in the horizontal direction by adjusting the timing of the operation of printhead 50 on successive revolutions. This mode of operation allows increases in horizontal resolution which otherwise is limited by the maximum operating rate for printhead 50.

Various ways in which the above described printing apparatus can be used to increase the resolution of an image produced by an ink jet printhead with little or no sacrifice of through put are described more fully in commonly assigned co-pending U.S. patent application Ser. No. 08/751,290, filed on even date herewith. (E-519)

EXAMPLE

It is believed that satisfactory performance can be achieved by using an ink having the following properties in a piezoelectric ink jet printhead to form images on a silicon rubber transfer roller:

| | |
|---|---|
| viscosity | 4–7 centipoise |
| surface tension | 40–60 millinewtons/meter |
| pH | 4–7 |

Formulation of a suitable ink would be well within the ability of an ink chemist of ordinary skill. The durometer of the transfer roller is not believed to be critical and can be selected to conform to anticipated surface irregularities.

The above description of preferred embodiments of the subject invention has been provided by way of illustration only and numerous other embodiments of the subject invention will be apparent to those skilled in the art from consideration of the detailed description set forth above and the attached drawings, accordingly, limitations on the subject invention are to be found only in the claims set forth below.

What is claimed:

1. A method for printing an image on a substrate, said method comprising the steps of:

a) providing a first station for temporary attachment of a transportable transfer roller;

b) providing an image forming mechanism responsive to signals representative of images to be printed proximate to said first station to form corresponding reversed images on a transfer roller attached to said first station;

c) attaching said transfer roller to said first station;

d) rotating said transportable transfer roller synchronously with operation of said image forming mechanism as said mechanism forms a reverse of said image on said transfer roller;

e) detaching said transfer roller from said first station f) transporting said transportable transfer roller to said substrate; and g) applying said transportable transfer roller to said substrate to print said image.

2. A method as described in claim 1 wherein said image is a postal indicia.

3. A method as described in claim 2 wherein said substrate is a package.

4. A method as described in claim 2 comprising the further steps of:

a) providing a fixed transfer roller at a second station;

b) positioning said image forming mechanism proximate to said first station when a remote substrate is to be printed; and c) positioning said image forming mechanism proximate to said second station when an envelope is to be printed.

5. A method as described in claim 4 wherein said transportable transfer roller rotates in a direction opposite to said fixed roller and said reversed image is formed on said transportable transfer roller in reverse sequence with respect to said fixed roller.

6. A method as described in claim 2 wherein said first station includes a mechanism for cleaning said transportable transfer roller, comprising the further step of activating said cleaning mechanism when said transportable transfer roller is attached to said first station after printing an indicia to remove any residual image from said transportable transfer roller.

7. A method as described in claim 2 wherein said transportable transfer roller includes a one-way, single revolution clutch to assure that said image is applied in the right direction and that only a single image is applied.

8. A method as described in claim 2 wherein said image is formed as successive interlaced portions during successive revolutions of said transportable transfer roller.

9. An apparatus for printing an image on a substrate, comprising:

a) a transportable transfer roller;

b) a first station for temporary attachment of said transportable transfer roller;

c) a second station, said second station including a fixed transfer roller;

d) an image forming mechanism responsive to signals representative of images to be printed to form corresponding reversed images on said transfer roller attached to said first station, said image forming mechanism being positioned proximate to said first station;

e) means for transporting said image forming mechanism between said first and second stations; and f) drive means for rotating said transportable transfer roller synchronously with operation of said image forming mechanism to form a reverse of said image when said transportable transfer roller is attached to said first station.

10. An apparatus as described in claim 9 wherein said first station includes a mechanism for cleaning said transportable transfer roller.

11. An apparatus as described in claim 9 wherein said transportable transfer roller rotates in a direction opposite to said fixed roller and said image forming mechanism forms said reversed image on said transportable transfer roller in reverse sequence with respect to said fixed roller.

12. An apparatus as described in claim 9 wherein said transportable transfer roller includes a one-way, single revolution clutch to assure that said image is applied in the right direction and that only a single image is applied.

13. An apparatus as described in claim 9 wherein said image forming mechanism forms said reversed image as successive interlaced portions during successive revolutions of said transportable transfer roller.

* * * * *